US007958900B2

(12) United States Patent
Bielle et al.

(10) Patent No.: US 7,958,900 B2
(45) Date of Patent: Jun. 14, 2011

(54) SCRUBBING MACHINE FOR CLEANING INSTRUMENTS

(75) Inventors: Jacques Henri Bielle, Chalons-en-Champagne (FR); Pierre Laujon, Aix en Provence (FR)

(73) Assignee: Marie Rose Laujon, Aixen Provence ( * ) Notice: Subject to any disclaimer, the term of this patent is extended or adjusted under 35 U.S.C. 154(b) by 482 days.

(21) Appl. No.: 11/883,467

(22) PCT Filed: Jan. 26, 2006

(86) PCT No.: PCT/FR2006/000198

§ 371 (c)(1), (2), (4) Date: May 14, 2008

(87) PCT Pub. No.: WO2006/079729

PCT Pub. Date: Aug. 3, 2006

(65) Prior Publication Data

US 2008/0276961 A1 Nov. 13, 2008

(30) Foreign Application Priority Data

Jan. 27, 2005 (FR) ..... 05 00849

(51) Int. Cl.

| | |
|---|---|
| ***B08B 3/12*** | (2006.01) |
| ***B08B 6/00*** | (2006.01) |
| ***B24B 31/00*** | (2006.01) |
| ***B24B 31/02*** | (2006.01) |

(52) U.S. Cl. ..... 134/184; 451/326; 451/330

(58) Field of Classification Search ..... 451/326–330; 134/184

See application file for complete search history.

(56) References Cited

U.S. PATENT DOCUMENTS

| | | | | |
|---|---|---|---|---|
| 1,224,191 | A * | 5/1917 | Medgyes | 451/326 |
| 2,978,850 | A * | 4/1961 | Gleszer | 451/35 |
| 3,642,142 | A * | 2/1972 | Barnebl et al. | 210/401 |
| 3,715,840 | A * | 2/1973 | Davidson | 451/326 |
| 4,011,063 | A * | 3/1977 | Johnston | 51/295 |
| 5,535,469 | A * | 7/1996 | Terry | 8/158 |
| 6,165,059 | A * | 12/2000 | Park | 451/330 |
| 6,277,011 | B1 * | 8/2001 | Moreillon | 451/326 |

FOREIGN PATENT DOCUMENTS

| | | | |
|---|---|---|---|
| DE | 2735399 | A * | 2/1979 |
| EP | 1207011 | | 5/2002 |
| EP | 1207011 | A2 * | 5/2002 |

(Continued)

OTHER PUBLICATIONS

FR 2682630 Machine Translation.*

(Continued)

*Primary Examiner* — Michael Barr
*Assistant Examiner* — Charles W Kling
(74) *Attorney, Agent, or Firm* — Horst M. Kasper

(57) ABSTRACT

The invention relates to a cleaning machine (MA) comprising a vessel (VE) having a stirring member (BA) mounted therein, the stirring member carrying a load of utensils of a first type. The stirring member also carries a load of utensils of a second type. The invention also provides a method of cleaning using such a machine, containing a cleaning liquid (WA). The method has a first cleaning stage during which the level of the liquid (WA) is lower than or equal to the level of the content of the stirring member (BA). It optionally includes a second cleaning stage during which the level of the liquid (WA) is higher than the level of the content of the stirring member (BA).

21 Claims, 3 Drawing Sheets

FOREIGN PATENT DOCUMENTS

| | | | | |
|---|---|---|---|---|
| FR | 2682630 | | | 4/1983 |
| FR | 2682630 | A1 | * | 4/1993 |
| JP | 51096866 | A | * | 8/1976 |
| WO | 9815383 | | | 4/1998 |
| WO | WO 9815383 | A1 | * | 4/1998 |
| WO | 9932261 | | | 1/1999 |
| WO | WO 9932261 | A1 | * | 7/1999 |

OTHER PUBLICATIONS

FR 2 682 630 Machine Translation.*
FR 2 682 630 English Translation.*
FR 2 682 630 Machine Translation Apr. 1993 Laujon P.*
FR 2 682 630 English Translation Apr. 1993 Laujon P.*

* cited by examiner

SCRUBBING MACHINE FOR CLEANING INSTRUMENTS

The invention relates to a cleaning machine.

The machine serves to scrub and burnish metal instruments such as cutlery, dishes, surgical instruments, or more generally all kinds of instrument. It finds an application in hospitals, restaurants, hotels, slaughterhouses.

Document FR 2 682 630 describes a machine comprising a vessel having a stirring member mounted therein. The stirring member essentially comprises a moving band mounted on transverse rollers. The band is driven by a drive roller rotated by a drive member. It presents a perforated structure allowing water and small pieces of waste to pass through. The band forms a pocket that serves to contain both a plurality of instruments for treatment and a load of cleaning utensils. It is bordered on either side by two vertical plane cheek plates secured to the vessel. It is partially immersed in a cleaning liquid, essentially water. The liquid passes freely through gaps between the cheek plates and the band, and also through the perforations in the band.

Furthermore, the machine has transverse deflectors arranged in register with top rollers against which the band bears. These deflectors serve to block utensils moving upwards along the band in its direction of movement. The rougher the band and the faster it moves, the greater this upward movement.

In a first use of that machine, utensils of a first type are loaded onto the band. The machine can then perform a scrubbing operation. The principle consists in scrubbing the instruments by means of these utensils in order to dislodge waste adhering thereto, while avoiding scratching the instruments. In addition, the action of the utensils must be sufficiently vigorous to clean thoroughly the microcavities that appear in the surfaces of the instruments. The waste is then disposed of through an emptying orifice situated in the bottom of the vessel. The scrubbing operation is relatively difficult to master at present, in terms both of its duration and of the hardness to be selected for the utensils.

In a second utilization of the machine, the load of utensils of the first type is removed and replaced by a load of utensils of a second type. The machine can then be used to perform a burnishing operation. The principle then consists in hardening the surfaces of the instruments for treatment using utensils such as beads made from one or more materials. The improvement in surface state is obtained without removing matter. Such beads, generally made of steel, roll continuously on the band. The instruments are immersed in the mass of moving beads which smooth the surfaces of the instruments by flattening any roughnesses thereon. Instead of attacking the metal as happens with manual cleaning, a burnishing operation compresses the surface layer of metal so as to restore the instrument to its original state. The lifetime of instruments treated in this way is considerably lengthened. A hard surface is better at withstanding wear and oxidation, which presents a clear advantage with silverplate. The burnishing operation is often performed in the presence of pure or soapy cold water and it lasts for a few minutes.

Burnishing is employed in the field of mechanical engineering for treating the pistons of engines. The burnishing must be sufficient to flatten any roughnesses present at the surfaces of such pistons. However, the flats as obtained in that way constitute skids that avoid seizing when putting the engine into service. It is necessary for burnishing to be limited so as to avoid completely eliminating the grooves of cavities suitable for filling with lubricating oil.

Such a machine presents a certain number of limitations.

Firstly, it is as though scrubbing and burnishing were performed in two separate machines, since it is essential to empty the machine completely between those two operations. It is appropriate to recover all of the utensils of a given type and replace them with utensils of the other type. Such manipulation is lengthy, tiresome, and awkward, particularly since the opening in the vessel is in its top.

Secondly, scrubbing is not mastered in satisfactory manner.

Thirdly, the pieces of waste removed from instruments for treatment during scrubbing can present dimensions that are greater than the dimensions of the perforations through the moving band. It is therefore not possible to remove all of the waste.

An object of the present invention is thus to facilitate scrubbing and burnishing instruments of all kinds.

According to the invention, a cleaning machine comprises a vessel having a stirring member mounted therein, the member carrying a load of utensils of a first type; furthermore, the member also carries a load of utensils of a second type.

This mixture of utensils means that it is no longer necessary to perform two distinct operations of scrubbing and burnishing, each making use of its own specific type of utensil. There is no longer any need to empty the machine.

In general, each utensil of the first type is in the form of a deformable block.

It follows that scrubbing performance is increased because the utensils of the first type are immersed in the utensils of the second type which press them against the instruments for treatment.

In addition, each block includes at least one edge.

Furthermore, at least one section of the edge is notched.

Preferably, at least a portion of the surface of such a block is abrasive.

In a first option, each block presents a core of carded nylon fiber coated in resin.

In a second option, each block presents a polyester support coated in expanded polyvinyl chloride.

Each block may optionally be weighted.

Weighting further improves scrubbing performance.

Advantageously, the loads of utensils are designed to be immersed in a washing liquid, with the density of the block being less than the density of the liquid.

In general, each utensil of the second type is in the form of a part that is of rounded shape.

For example, the part may be a bead presenting a diameter of less than 50 millimeters (mm).

In addition, the part can be of stainless steel.

Advantageously, the loads are designed to be immersed in a washing liquid, and the density of the part is greater than the density of the liquid.

The beads also serve to grind pieces of waste separated from the instruments during scrubbing. As a result, all of the pieces of waste present dimensions that are smaller than the dimensions of the perforations through the moving band, thus enabling them to be removed without difficulty.

In a first embodiment, the stirring member is a rotary drum.

In a second embodiment, the stirring member is constituted by a moving band mounted on transverse rollers and bordered by two vertical cheek plates.

It is also appropriate to draw attention to a fourth limitation of prior art machines. The deflectors become less effective when the utensils are lightweight. If light utensils come close to the deflectors, they increase band wear and the danger of the band jamming.

According to an additional characteristic of the invention, a transverse deflector is arranged in register with one of the rollers and is provided with nozzles for delivering water downwards so as to oppose the upward movement of the utensils.

The nozzles are also steerable.

The deflector is effective in opposing upward movement of the blocks along the moving band when they collect together at the surface of the water and when the water level is high. By getting rid of any rubbing against the band and the deflector, consequent wear is eliminated, as are the risks of the band jamming.

It is also appropriate to mention a fifth limitation of prior art machines. Poor centering of the band relative to the side cheek plates leads to premature wear of the band on one side and to excessive clearance on the other side of the band.

According to another important characteristic of the invention, the cheek plates are provided with a device for taking up clearance relative to the moving band.

Advantageously, the clearance take-up device comprises a plurality of centering pegs interposed between the vessel and each of the cheek plates.

By way of example, each peg includes return means working in compression.

The centering of the band that is obtained relative to the cheek plates avoids premature wear on one side of the band and excessive clearance on the other side of the band.

The invention also provides a method of cleaning by means of a machine as described above, the machine containing a washing liquid; the method has a first stage of cleaning during which the level of the liquid is less than or equal to the level of the content of the stirring member.

This makes it possible to mix the blocks and the parts together. The blocks are pressed against the instruments by the heavier parts and can therefore perform scrubbing.

The method preferably also includes a stage of cleaning during which the level of the liquid is higher than the level of the content of the stirring member.

This makes it possible to cause the blocks to rise above the parts, with the instruments for cleaning then being subjected to burnishing.

Scrubbing and burnishing require two stages, each making use of utensils of a given type, and the operation of selecting the required type is performed by adapting the level of the liquid.

The present invention appears below in greater detail in the context of the following description of embodiments given by way of illustration and with reference to the accompanying drawings, in which.

Elements present in more than one figure are given the same references in all of them.

Figure 1:
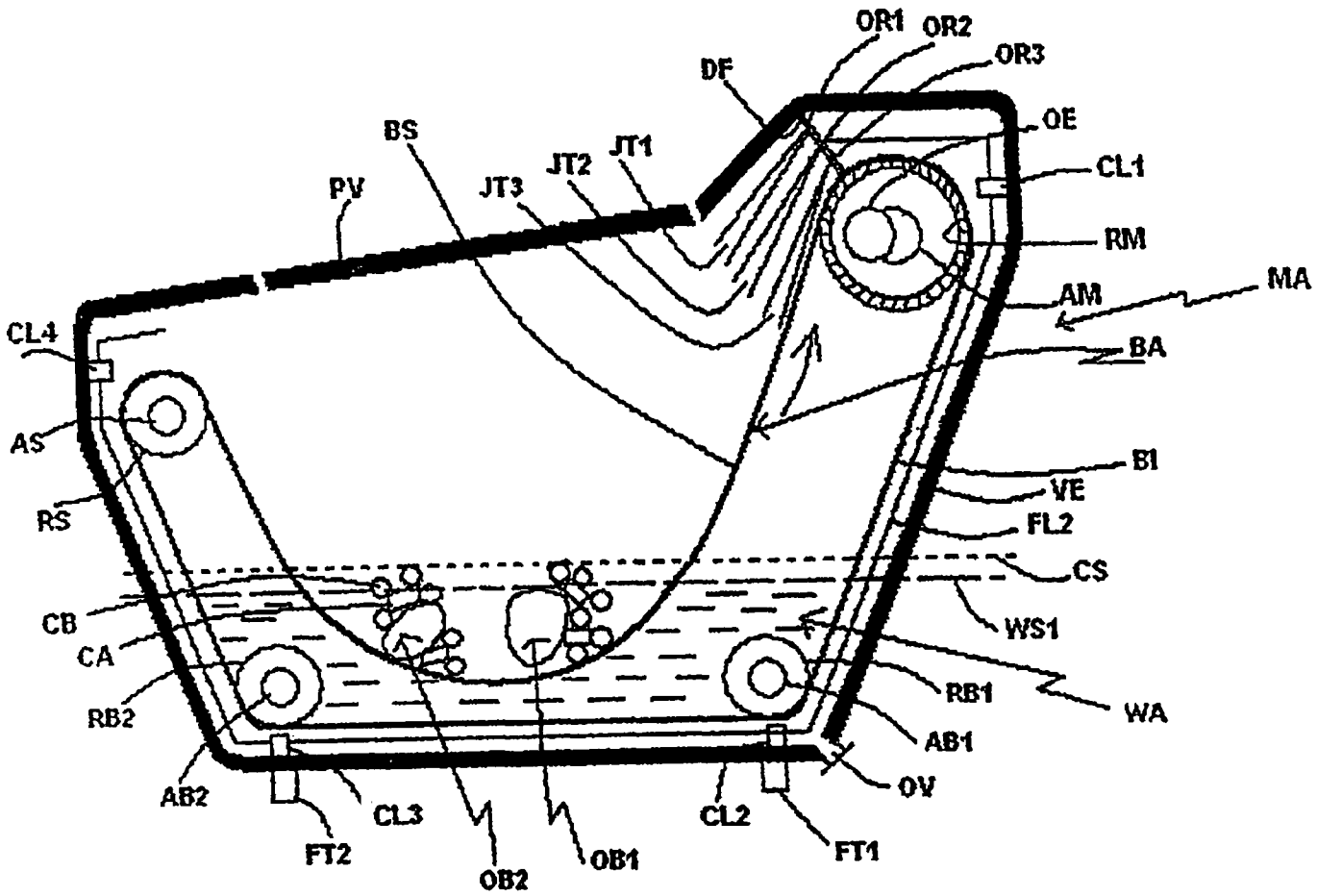
FIG. 1 is a longitudinal section of a cleaning machine during a scrubbing stage.

With reference to FIG. 1, a cleaning machine MA comprises a vessel VE fitted with a lid PV. The vessel is mounted on one or more feet, two of which FT1 and FT2 can be seen in the figure, and it is provided with an emptying orifice OV having a cock that is not shown. In order to avoid overloading the drawing, neither the water inlet, nor the electrical connectors, nor the surveillance portholes are shown.

The machine contains a moving band BA resting on four transverse horizontal rollers, a drive roller RM, a tracking roller RS, a first bottom roller RB1, and a second bottom roller RB2. The top section BS of the band is free to deform under the weight of the load it supports between the drive roller RM having a drive axis AM and the tracking roller RS having a tracking axis AS. The drive roller RM is higher than the tracking roller. The top section BS thus forms a pocket. The bottom section BI of the band BA comes into contact with the two bottom rollers RB1, RB2 having respective axes AB1, AB2. The roller axes AM, AS, AB1, AB2 are all horizontal and the axis of the drive roller RM is driven by a drive member OE such as an electric motor. The band BA then moves in the direction shown by an arrow.

A load of utensils of a first type, specifically scrubbing utensils CA, and a load of utensils of a second type, burnishing utensils CB in this example, are put into the vessel VE.

The utensils CA, CB, and also two instruments OB1, OB2 for treatment are loaded in bulk on the moving band BA. The level of the load is represented by a horizontal line CS of short dashes. Water WA is put into the vessel VE.

The two sections BS and BI of the band BA are immersed in part in the water WA. The water level is represented by a horizontal line WS1 of long dashes, situated below the load level CS.

The band BA is bordered by two vertical side cheek plates extending parallel to the plane of the figure. The outline of these cheek plates FL2 can be seen in FIG. 1. This cheek plate is connected to the wall of the vessel VE via flexible spacers CL1, CL2, CL3, CL4.

When the drive roller RM drives the moving band BA, the scrubbing utensils CA, the burnishing utensils CB, and the instruments for treatment OB1, OB2 are shaken and mixed together. In an initial stage of cleaning, specifically a scrubbing stage, the water level is below the level of the instruments. The scrubbing utensils CA have no tendency to float. The burnishing utensils aCB press and jam them in contact with the instruments OB1, OB2. Their projecting shapes enable an effective scrubbing action to be performed, thereby encouraging extraction of all the waste present in the cavities of the instruments for treatment OB1, OB2.

In a first option, the scrubbing utensils CA are obtained from resin-coated carded nylon fiber having abrasive grains sprayed thereon.

In a second option, the scrubbing utensils CA are obtained from expanded polyvinyl chloride on a polyester support.

There is nothing against implementing other kinds of scrubbing utensils CA such as abrasive porous grains, crushed fruit stones, etc.

It is also possible to weight these scrubbing utensils CA to bring their density to the desired value.

The scrubbing utensils are generally polyhedra, in other words they are of polygonal section.

In addition, when the scrubbing utensils CA are provided with notched edges, that enables them to reach the bottoms of cavities present in the instruments OB1, OB2 for cleaning.

Figure 2:
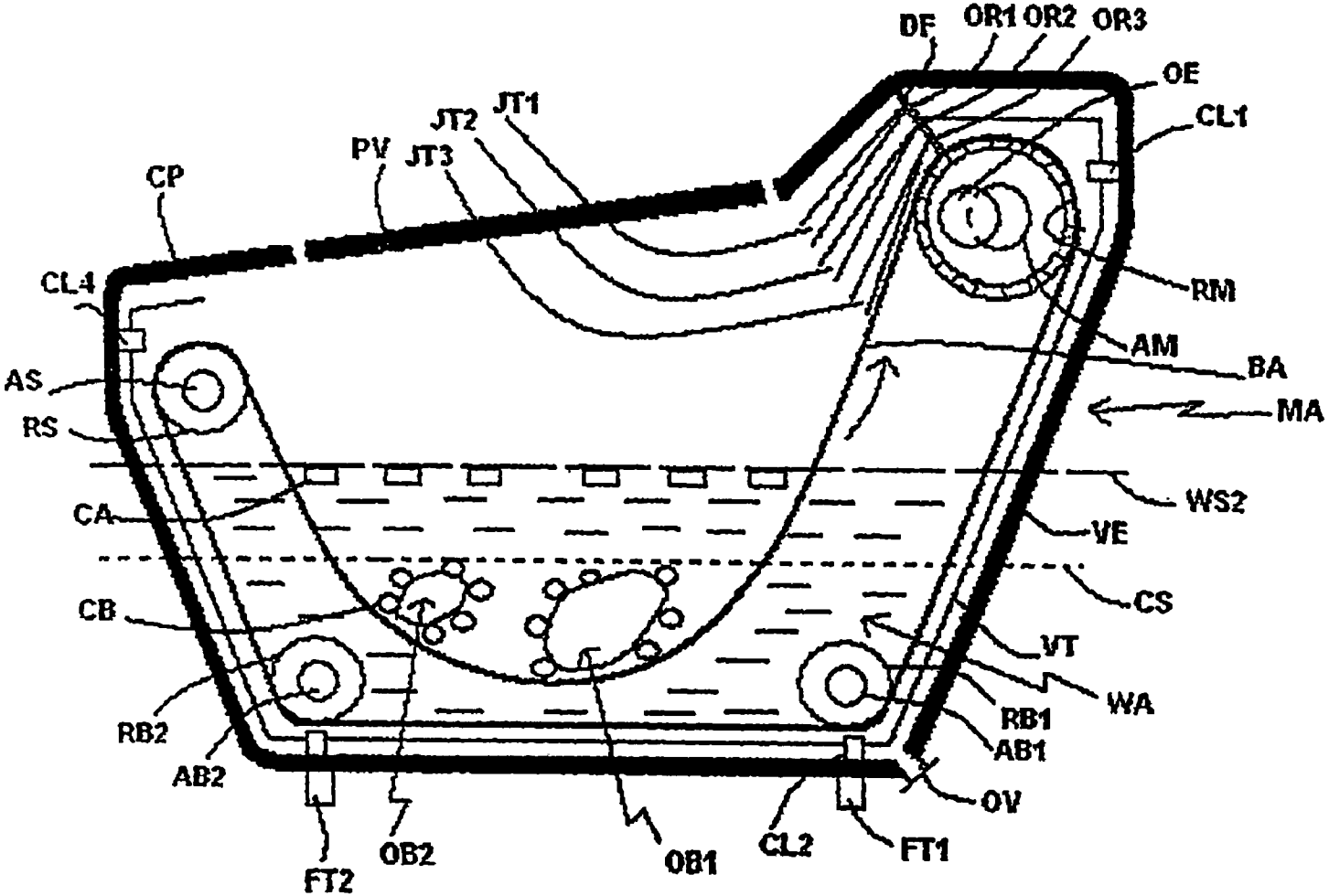
FIG. 2 is a longitudinal section of a cleaning machine during a burnishing stage.

With reference to FIG. 2, in a second stage of cleaning, a burnishing stage, water WA is added into the machine MA.

The level of water is now represented by a line WS2 of long dashes. The level of the load remains represented by the horizontal line CS of short dashes.

In this configuration, the water level WS2 is well above the level CS of the load. Since the scrubbing utensils CA present density that is less than that of water WA, they float to the surface. At the bottom there remain only the instruments for cleaning OB1, OB2 together with the burnishing utensils CB that present density greater than that of water WA.

When the roller RM is driving the moving band BA, the burnishing utensils CB are the only utensils in contact with the instruments OB1, OB2 for cleaning. Their rounded shape and their density greater than that of water facilitates an effective burnishing action.

The burnishing utensils CB in this example are rigid parts of rounded shape. In a preferred embodiment, these utensils are beads, e.g. made of stainless steel. These beads advantageously present a diameter of less than 50 mm.

The burnishing utensils CB also serve to grind the waste produced during the scrubbing stage. Once the waste has been reduced to pieces of smaller size, it can pass through openings in the moving band BA and then go out through the emptying orifice OV of the vessel VE when the water WA is emptied out.

The invention also makes it possible to solve a problem that arises when the band BA is moving: the utensils CA, CB and also the instruments OB1, OB2 tend to move up along the band that is driving them.

The scrubbing utensils CA that are lighter than water move further than the burnishing utensils CB that are heavier than water. They come close to the deflector DF arranged transversely over the band BA in the zone where it comes into contact with the drive roller RM.

In order to avoid any risk of the scrubbing utensils CA becoming jammed between the deflector DP and the moving band BA, the deflector is provided with nozzles OR1, OR2, OR3. These nozzles deliver jets of water JT1, JT2, JT3 tangentially to the moving band BA and pointing downwards. These jets of water oppose the upward movement of the scrubbing utensils CA. The nozzles OR1, OR2, OR3 are advantageously arranged on a strip.

In a variant, the jets of water are steerable. The pressure of the jets of water can also be modulated and is adapted to the density of the utensils CA, CB.

The invention also makes it possible to solve the problem of taking up clearance between the cheek plates FL1, FL2 and the moving band BA.

Figure 3:
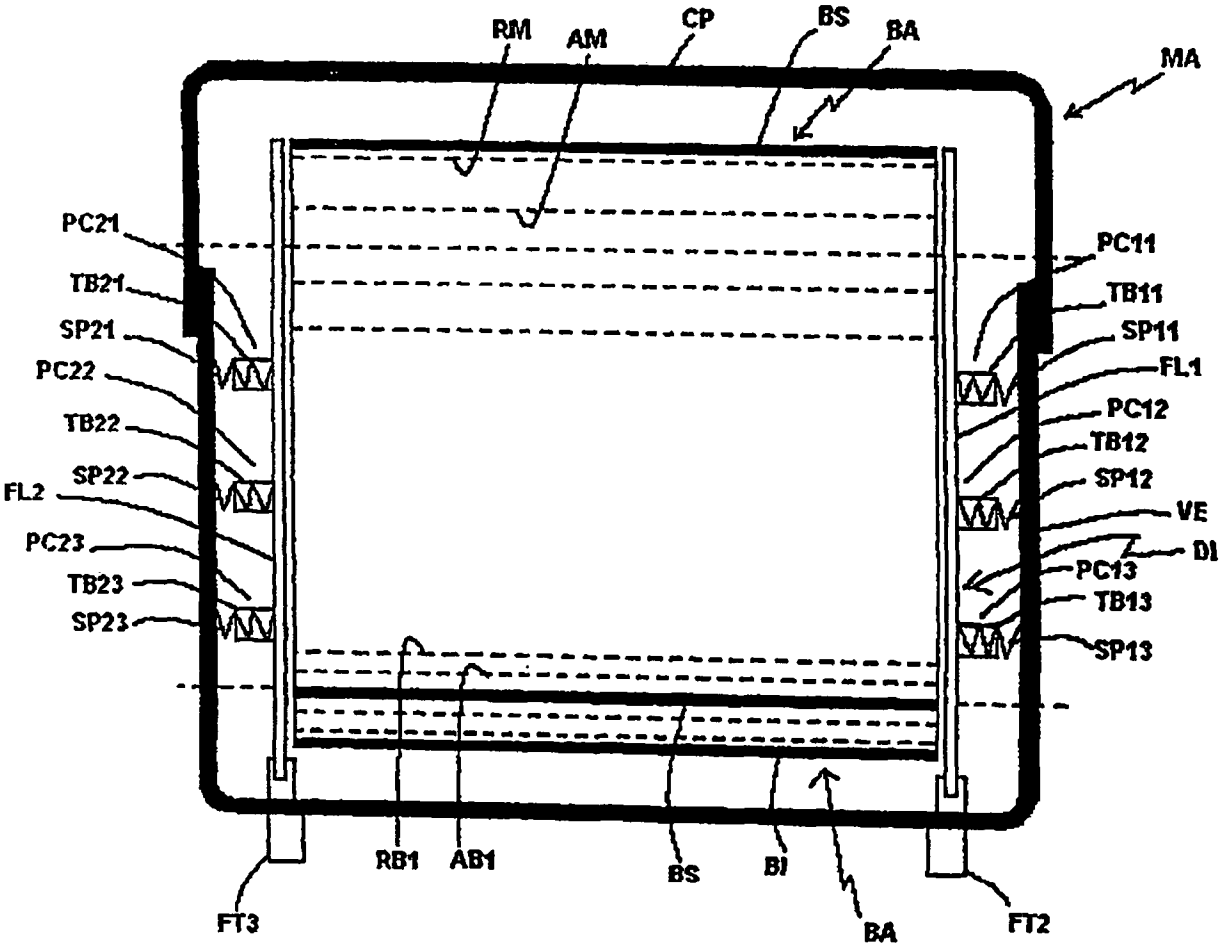
FIG. 3 is a cross-section view perpendicular to the preceding views showing a cleaning machine provided with an automatic device for taking up clearance.

Thus, the cheek plates are mounted on flexible spacers CL1, CL2, CL3, CL4 connected to the walls of the vessel VE and they are also provided with a clearance take-up device D1 as shown in FIG. 3.

This device connects each cheek plate FL1, FL2 to the vessel VE via three centering pegs PC11-PC12-PC13, PC21-PC22-PC23. Each of these pegs comprises a tube TB11-TB12-TB13, TB21-TB22-TB23 secured to the corresponding cheek plate FL1, FL2 and containing a spring SP11-SP12-SP13, SP21-SP22-SP23 working in compression.

This arrangement makes it possible to maintain constant pressure between the band BA and the side cheek plates FL1, FL2. It makes it possible to avoid wear taking place too quickly on one side of the band, which wear could lead to large pieces of waste and small treatment utensils passing between the other side of the band and the cheek plate facing it. Utensils are no longer lost and the lifetime of the band is extended. In addition, maintenance of the machine is simplified.

The embodiment described above relates to a machine having a moving band. The person skilled in the art will have no difficulty in replacing such a band with some other stirring member. Mention can be made in particular to a rotary drum or to a vibrating bin. There is then no need to have recourse to deflectors or to the device for taking up clearance.

Furthermore, there is nothing against providing more than two types of utensil.

The embodiments of the invention described above have been selected because of their concrete nature. Nevertheless, it is not possible to list exhaustively all of the embodiments covered by the invention. In particular, any step or means described may be replaced by an equivalent step or means without going beyond the ambit of the present invention.

The invention claimed is:

1. A cleaning machine (MA) comprising a vessel (VE) having a stirring member (BA) mounted therein, the stirring member carrying a load of utensils of a first type, and a load of utensils of a second type, the loads being designed to be immersed in a washing liquid (WA), the utensils of the first type being in the form of deformable blocks (CA), the density of said blocks (CA) being less than the density of said liquid (WA), each of the utensils of the second type being in the form of rigid parts (CB) of rounded shape, and the density of said parts (CB) being greater than the density of the liquid (WA); wherein said stirring member (BA) is constituted by a moving band mounted on transverse rollers (RM, RS) and bordered by two vertical cheek plates (FL1, FL2); wherein said cheek plates (FL1, FL2) are provided with a device (DI) for taking up clearance relative to the moving band (BA); wherein said clearance take-up device (DI) is constituted by a plurality of centering pegs (PC11-PC12-PC13, PC21-PC22-PC23) interposed between said vessel (VE) and each of said cheek plates (FL1, FL2); and wherein said centering pegs (PC11-PC12-PC13, PC21-PC22-PC23) include return means (SP11-SP12-SP13, SP21-SP22-SP23) working in compression.

2. A machine according to claim 1, characterized in that said block (CA) includes at least one edge.

3. A machine according to claim 2, characterized in that at least one section of said edge is notched.

4. A machine according to claim 2, characterized in that at least a portion of the surface of said block (CA) is abrasive.

5. A machine according to claim 2, characterized in that said block (CA) presents a core of carded nylon fiber coated in resin.

6. A machine according to claim 2, characterized in that said block (CA) presents a polyester support coated in expanded polyvinyl chloride.

7. A machine according to claim 2, characterized in that said block (CA) is weighted.

8. A machine according to claim 2, characterized in that said part (CB) is a bead.

9. A machine according to claim 2, characterized in that said part (CB) is made of stainless steel.

10. A machine according to claim 2, characterized in that a transverse deflector (DP) is disposed adjacent to one of said rollers (RM, RS), said deflector (DP) being provided with downwardly-directed nozzles (OR1, OR2, OR3) to oppose upward movement of said utensils (CA, CB).

11. A machine according to claim 10, characterized in that said nozzles (OR1, OR2, OR3) are steerable.

12. A machine according to claim 1, characterized in that at least a portion of the surface of said block (CA) is abrasive.

13. A machine according to claim 1, characterized in that said block (CA) presents a core of carded nylon fiber coated in resin.

14. A machine according to claim 1, characterized in that said block (CA) presents a polyester support coated in expanded polyvinyl chloride.

15. A machine according to claim 1, characterized in that said block (CA) is weighted.

16. A machine according to claim 1, characterized in that said part (CB) is a bead.

17. A machine according to claim 16, characterized in that said bead has a diameter of less than 50 mm.

18. A machine according to claim 1, characterized in that said part (CB) is made of stainless steel.

19. A machine according to claim 1, characterized in that a transverse deflector (DP) is disposed adjacent to one of said rollers (RM, RS), said deflector (DP) being provided with downwardly-directed nozzles (OR1, OR2, OR3) to oppose upward movement of said utensils (CA, CB).

20. A machine according to claim 19, characterized in that said nozzles (OR1, OR2, OR3) are steerable.

21. A machine according to claim 19, characterized in that said block (CA) presents a core of carded nylon fiber coated in resin.

* * * * *